US005816995A

United States Patent [19]

Tekavec et al.

[11] Patent Number: 5,816,995

[45] **Date of Patent: *Oct. 6, 1998**

[54] DISPENSING TABLE FOR CUSHIONING CONVERSION MACHINE

[75] Inventors: James E. Tekavec, Willoughby; James A. Simmons, Painesville Township, both of Ohio

[73] Assignee: Ranpak Corp., Concord Township, Ohio

[ * ] Notice: The term of this patent shall not extend beyond the expiration date of Pat. No. 5,487,717.

[21] Appl. No.: 594,293

[22] Filed: Jan. 30, 1996

Related U.S. Application Data

[63] Continuation of Ser. No. 155,931, Nov. 23, 1993, Pat. No. 5,487,717, which is a continuation-in-part of Ser. No. 66,337, May 21, 1993, abandoned.

[51] Int. Cl.[6] ..... B31F 1/10

[52] U.S. Cl. ..... 493/352; 493/346; 493/407; 493/439; 493/464; 493/967

[58] Field of Search ..... 493/346, 352, 493/354, 355, 356, 357, 407, 439, 464, 967

[56] References Cited

U.S. PATENT DOCUMENTS

| | | | |
|---|---|---|---|
| 2,599,096 | 6/1952 | Dirksen . | |
| 5,468,208 | 11/1995 | Armington et al. | 493/967 |
| 5,487,717 | 1/1996 | Teravac et al. | 493/967 |

FOREIGN PATENT DOCUMENTS

| | | |
|---|---|---|
| 2326271 | 10/1975 | France . |
| 90053109 | 5/1990 | Germany . |
| 9205948 | 4/1992 | WIPO . |

OTHER PUBLICATIONS

Bourgun Newsletter—Jun. 1992.

*Primary Examiner*—Eileen P. Morgan
*Attorney, Agent, or Firm*—Renner, Otto, Boisselle & Sklar, P.L.L.

[57] ABSTRACT

In combination, a dispensing table (10) and a cushioning conversion machine (12) which is slidably mounted to the table (10). The table (10) includes a substantially horizontal work platform (14) and the machine (12) is situated below the platform (14). The cushioning conversion machine (10) includes conversion assemblies (50, 52, 54, 56, 58) which convert stock material (S) into a cushioning product (P). The cushioning conversion machine (12) is slidable to an operating position whereat the cushioning product (P) is deposited on the work platform (14) during operation of the machine. Preferably, the machine (12) is also slidable to an upstream position whereat its upstream portion projects outwardly from the table (10) and loading and threading procedures can be easily performed. Additionally or alternatively, the machine (12) is preferably slidable to a downstream position whereat its downstream portion projects outwardly from the table (10) and inspection and maintenance may be conveniently conducted on certain components of the machine (12).

11 Claims, 5 Drawing Sheets

DISPENSING TABLE FOR CUSHIONING CONVERSION MACHINE

RELATED APPLICATIONS

This is a continuation of application Ser. No. 08/155,931, filed Nov. 23, 1993 now U.S. Pat. No. 5,487,717 which is a CIP of Ser. No. 66,337 filed May 21, 1993 now abandoned and which is entitled "Dispensing Table for a Cushioning Conversion Machine." This earlier application is assigned to the assignee of the present invention and its entire disclosure is hereby incorporated by reference.

FIELD OF THE INVENTION

This invention relates generally as indicated to a dispensing table for a cushioning conversion machine. More particularly, the present invention relates to a dispensing table designed so that a cushioning conversion machine may be slidably mounted below the table's work platform. This slidable mounting of the machine allows for convenient loading of stock material, easy threading of stock material, and/or handy maintenance of certain components of the machine.

BACKGROUND AND SUMMARY OF THE INVENTION

In the process of shipping an item from one location to another, a protective packaging material is typically placed in the shipping container to fill any voids and/or to cushion the item during the shipping process. Some commonly used protective packaging materials are plastic foam peanuts and plastic bubble pack. While these conventional plastic materials seem to perform adequately as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

These and other disadvantages of conventional plastic packaging materials have made paper protective packaging material a very popular alterative. Paper is biodegradable, recyclable and renewable; making it an environmentally responsible choice for conscientious companies.

While paper in sheet form could possibly be used as a protective packaging material, it is usually preferable to convert the sheets of paper into a relatively low density pad-like cushioning dunnage product. This conversion may be accomplished by a cushioning conversion machine, such as that disclosed in U.S. application Ser. Nos. 07/840,306; 07/840,306; 07/712,203 (now U.S. Pat. No. 5,123,889); and 07/592,572. (These applications are all assigned to the assignee of the present application and their entire disclosures are hereby incorporated by reference.)

Such a cushioning conversion machine converts sheet-like stock material, such as multi-ply paper rolled onto a hollow tube, into relatively low density pads. Specifically, the machine converts this stock material into a continuous unconnected strip having lateral pillow-like portions separated by a thin central band. This strip is coined along its central band to form a coined strip which is cut into sections, or pads, of a desired length.

The cushioning conversion machine disclosed in the above-identified applications includes a frame and conversion assemblies which are mounted to the frame. The machine's conversion assemblies include a stock supply assembly, a forming assembly, a gear assembly, a cutting assembly, and a post-cutting constraining assembly. The cushioning conversion machine may further comprise electric circuitry which electrically controls at least some of the conversion assemblies. In the preferred machine, the electrically controlled conversion assemblies are the gear assembly and the cutting assembly. This electric circuitry is usually comprises an electric panel which is often used for testing purposes.

In preparation for operation of the machine, the stock supply assembly is loaded with stock material. Thereafter, the leading portion of the stock material is "threaded" through the forming assembly. This threading typically entails folding the leading portion of the stock material in a triangular-like fashion and manually pushing this leading portion through the forming assembly (i.e. a forming frame and a converging chute) so that the "point" of the triangle is positioned between the gears of the gear assembly. During the threading procedure, a top cover of the machine frame is pivoted about a longitudinal hinge thereby allowing accessibility to the forming assembly.

In operation of the cushioning conversion machine, the stock supply assembly supplies the stock material to the forming assembly. The forming assembly causes inward rolling of the lateral edges of the sheet-like stock material to form the lateral pillow-like portions of the continuous strip. The gear assembly pulls the stock material through the machine and also coins the central band of the continuous strip to form the coined strip. The coined strip travels downstream to the cutting assembly which cuts the coined strip into sections, or pads, of a desired length. These cut sections then travel through the post-cutting constraining assembly.

Applicants appreciated that such a cushioning conversion machine could be situated below the work platform of a dispensing table. In such an arrangement, the final outlet of the machine (i,e, the exit opening of the post-cutting constraining assembly), could be aligned with an opening in the table's work platform. In this manner, the cushioning product, or pad, would be deposited on the work platform during operation of the machine. Consequently, a packaging person could conveniently place the pad in a shipping box to fill any voids and/or to cushion an item during the shipping process.

While applicants appreciated that the machine/table combination discussed in the preceding paragraph could perform very well during actual packaging procedures, they also appreciated that certain inconveniences could be encountered during preparation and/or service procedures. For example, because the machine is situated below the table's work platform, a packaging person could be required to reach under the platform to load/unload stock material. Additionally, because the cover's door was longitudinally hinged, it would be unopenable during the threading procedure unless the machine was totally withdrawn from under the table. For this same reason, performing scheduled maintenance on the cutting assembly (i.e., sharpening its blades), and/or testing of the electric panel, could require either relocating the machine or maneuvering under the table to reach the relevant components.

Applicants therefore developed the dispensing table of the present invention. With this table, the cushioning conversion machine is slidably mounted beneath the work platform and it is slidable among an operating position, a loading position, and a maintenance position. In the operating position, the final outlet of the machine (i,e, the exit opening of the post-cutting constraining assembly), is aligned with an opening in the work platform. Consequently, the cushioning product is deposited on the work platform during operation of the machine. In the loading (or upstream) position, an upstream portion of the machine projects outwardly from the table whereby the stock supply assembly is accessible for loading. Additionally, if a cover according to the present invention is used, the forming assembly can be exposed when the machine is in the loading position for threading purposes. In the maintenance (or downstream) position, a downstream portion of the machine projects outwardly from the table whereby the cutting assembly and/or the electric panel are accessible for routine maintenance.

More particularly, the present invention provides, in combination, a dispensing table and a cushioning conversion machine which is slidably mounted to the table. The table includes a substantially horizontal work platform. The cushioning conversion machine includes a frame and conversion assemblies which are mounted to the frame and which convert stock material into a cushioning product. The cushioning conversion machine is slidable to an operating position whereat the cushioning product is deposited on the work platform during operation of the machine.

Preferably, the machine is slidable to an upstream position whereat its upstream portion projects outwardly from the table. With the preferred cushioning conversion machine, the stock supply assembly would be located outward from the table and thus accessible for loading. Also, if a top cover according to the present invention is used (i.e., one including a laterally extending hinge), the forming assembly may be exposed for threading purposes.

Additionally or alternatively, the machine is preferably slidable to a downstream position whereat its downstream portion projects outwardly from the table. If the preferred cushioning conversion machine is used, the cutting assembly and/or the electric panel would project outwardly from the table. In this manner, these components could be conveniently serviced.

These and other features of the invention are fully described and particularly pointed out in the claims. The following descriptive annexed drawings set forth in detail a certain illustrative embodiment, this embodiment being indicative of but one of the various ways in which the principles of the invention may be employed.

DETAILED DESCRIPTION

Figure 1:
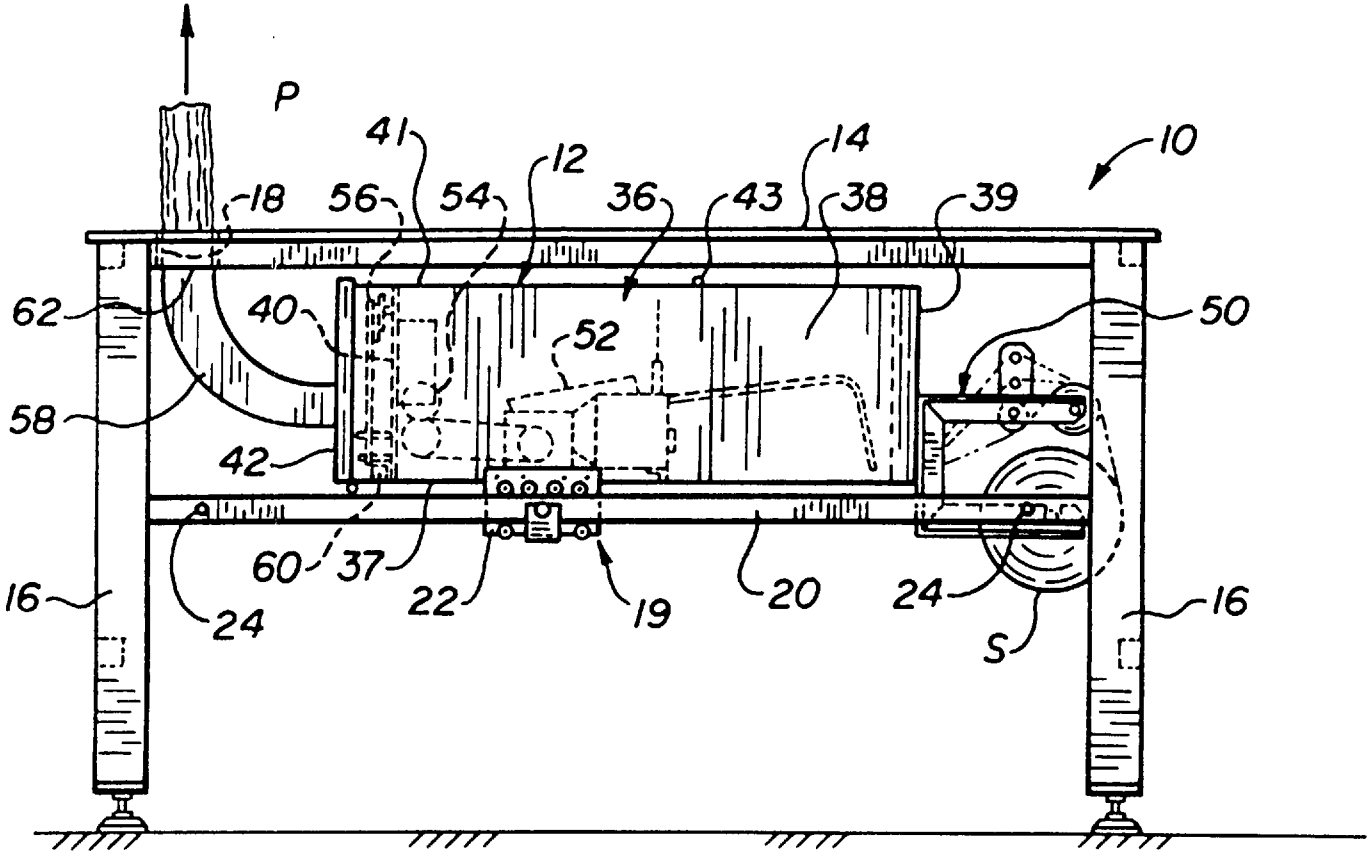
FIG. 1 is a side view of a table/machine combination according to the present invention, the combination including a dispensing table and a cushioning conversion machine slidably mounted thereto, the machine being shown in an operating position.
Figure 2:
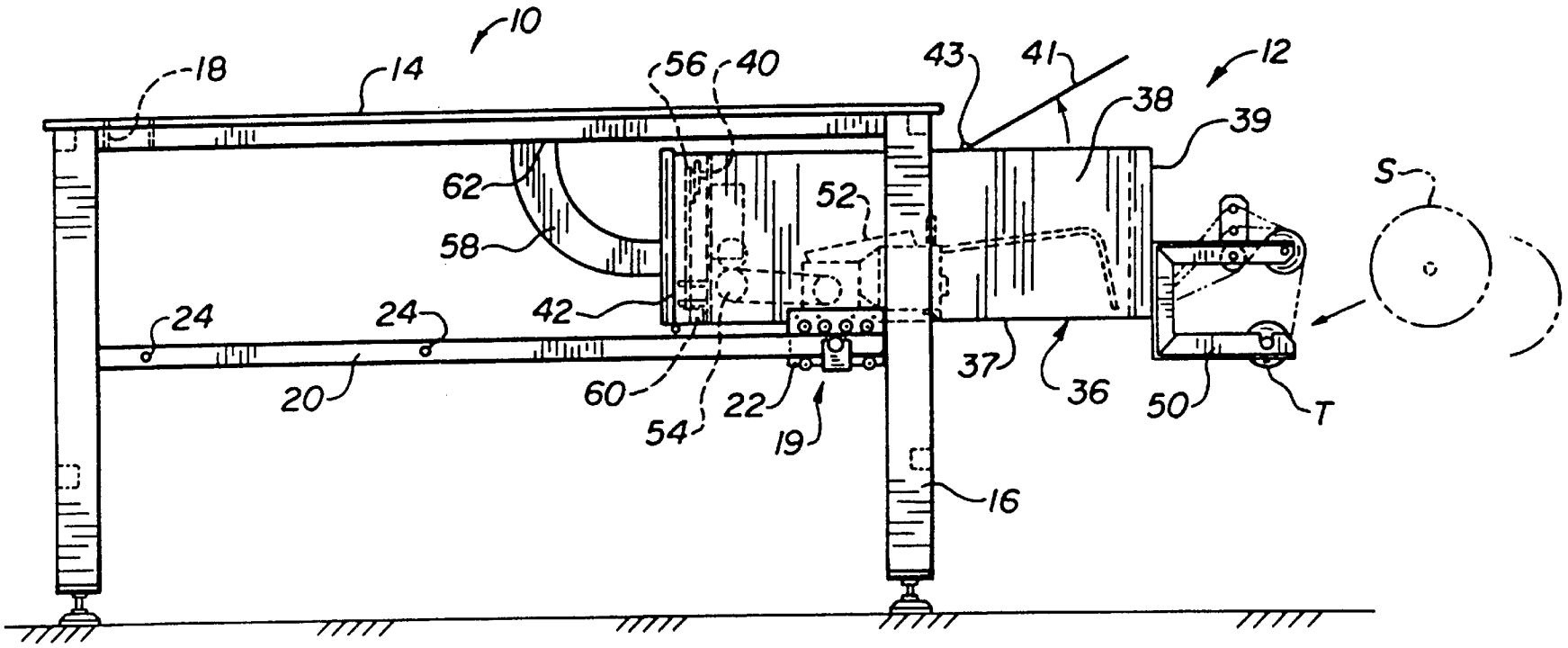
FIG. 2 is a side view of the table/machine combination, the machine being shown in a downstream position.
Figure 3:
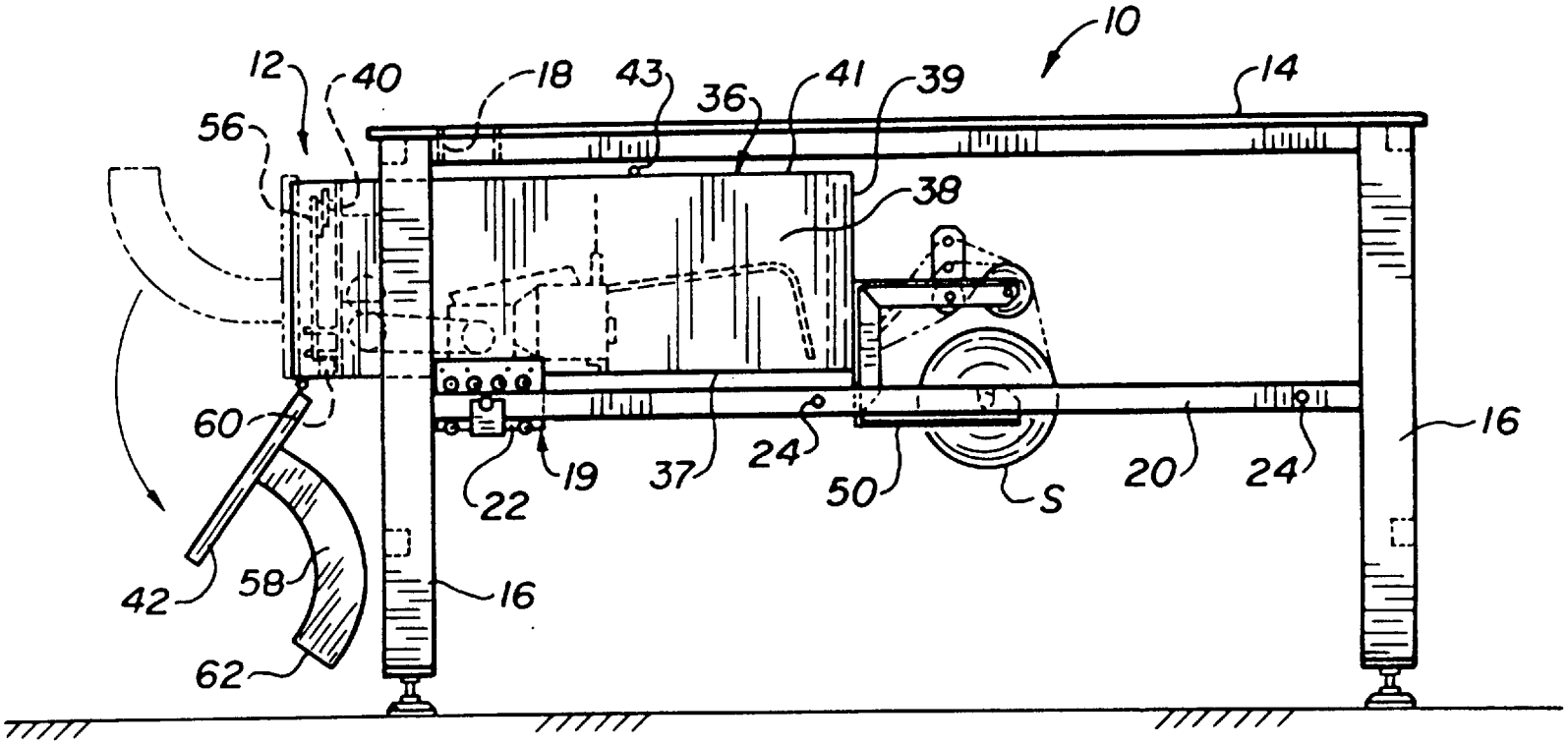
FIG. 3 is a side view of the table/machine combination, the machine being shown in an upstream position.

Referring now to the drawings in detail and initially to FIGS. 1–3, a table/machine combination according to the present invention is shown. The combination includes a dispensing table 10 and a cushioning conversion machine 12 which is slidably mounted to the table 10. In FIG. 1, the machine 12 is shown in an operating position, in FIG. 2, the machine 12 is shown in an upstream position, and in FIG. 3, the machine 12 is shown in a downstream position. As is explained in more detail below, this slidable mounting of the machine 12 allows for convenient loading of stock material, easy threading of the stock material, and/or handy maintenance of certain components of the machine 12.

The dispensing table 10 comprises a horizontal work platform 14 and support members 16 which support the platform 14. The work platform 14 is preferably made of arborite solid grade laminate and includes an opening 18 through which (when the machine 12 is slid to the operating position and it is operating) cushioning products, or pads, P, are discharged. (See FIG. 1.) In this manner, a packaging person may conveniently place the pad P in a shipping box to fill any voids and/or to cushion an item during the shipping process.

The support members 16 may be of a variety of forms provided that an appropriate cavity is provided just below the work platform 14 for the mounting and selective sliding of the machine 12. In the preferred and illustrated embodiment, the support members 16 consist of four vertical legs which position the work platform 14 at a convenient height for a worker performing packaging duties. Preferably, this height is between two and five feet, and, more preferably, this height is approximately three feet.

Figure 4:
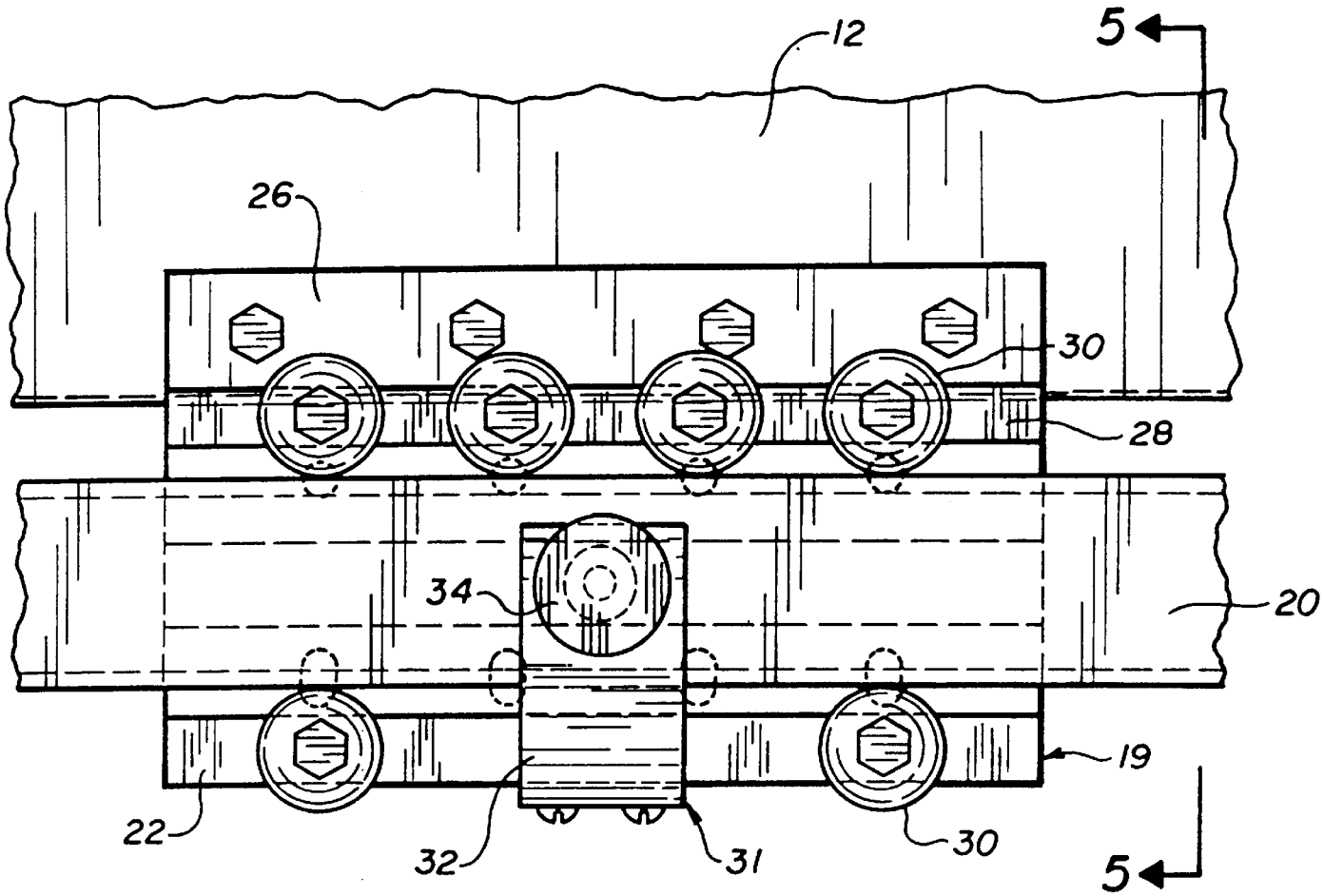
FIG. 4 is a side view of a sliding assembly which slidably mounts the cushioning conversion machine to the table.
Figure 5:
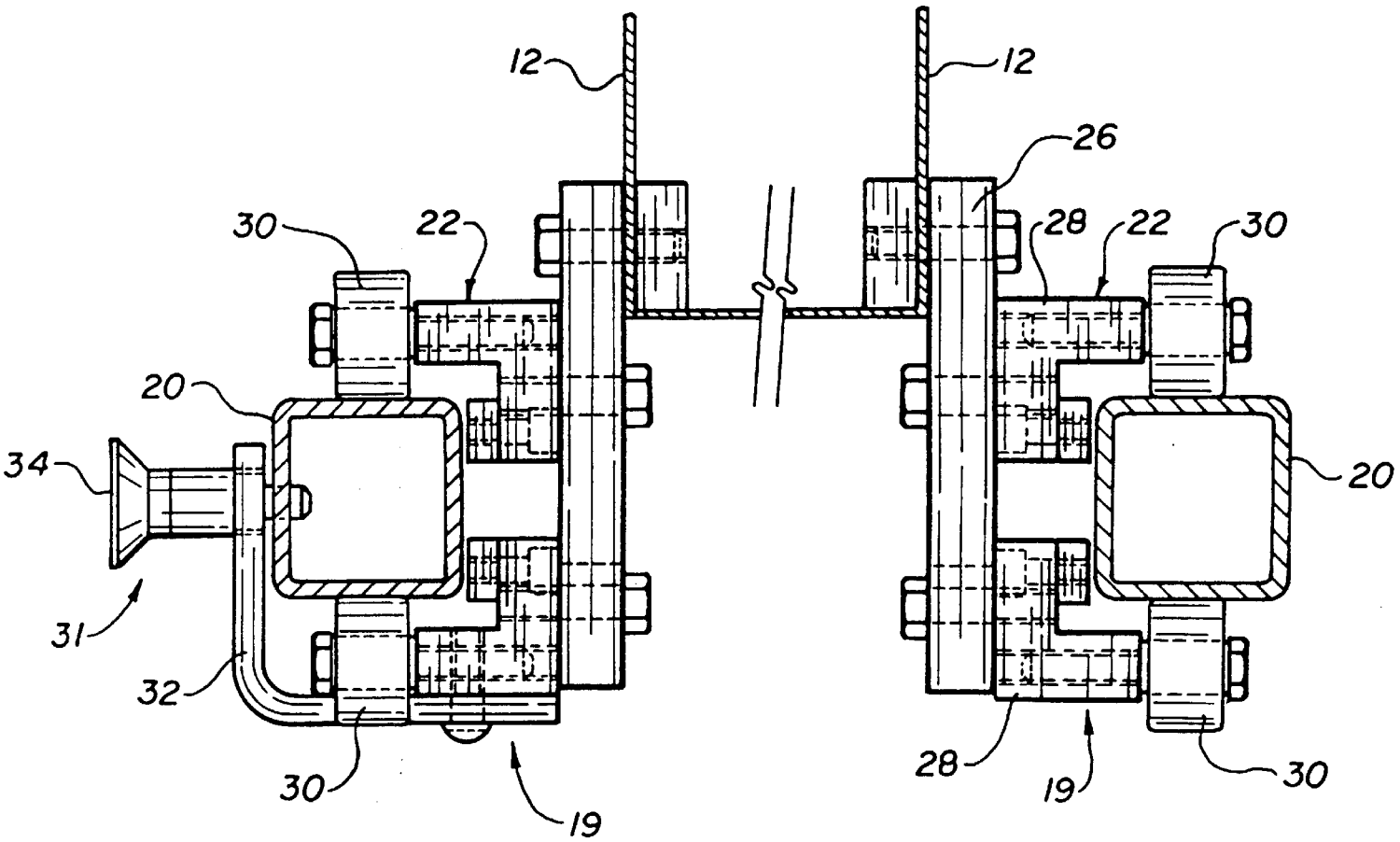
FIG. 5 is a sectional view of the sliding assembly as seen along line 5—5 in FIG. 4.

The dispensing table 10 further comprises a slide assembly 19 for slidable mounting of the machine 12. The slide assembly 19, which is shown in detail in FIGS. 4 and 5, includes a pair of parallel tracks 20 and a pair of sliding devices 22. In the preferred and illustrated embodiment, the tracks 20 are tubular steel members which horizontally extend between, and are attached to, the front/back legs 16. One of the tracks 20 includes locking components 24 which coordinate with the locking component of one of the sliding devices 22 to lock the machine 12 in the desired position. In the illustrated and preferred embodiment, the locking components 24 consist of three spaced openings on the outer side of the front tubular track 20. (See FIGS. 1–3.) The intermediate opening corresponds to the operating position, the upstream opening corresponds to the upstream position, and the downstream opening corresponds to the downstream position.

The sliding devices 22 each comprise a coupling plate 26, a pair of roller-mounting members 28, and rollers 30. The coupling plates 26 are made of aluminum and are generally rectangular in shape. (See FIG. 4.) The roller-mounting members 28 are also made of aluminum and each has a generally L-shaped cross-sectional geometry. (See FIG. 5.) Regarding the rollers 30, they each are made of steel and they each have an approximately one inch diameter and are about five-eights of an inch thick.

For each sliding device 22, the top edge of the coupling plate 26 is coupled to the machine 12 via capscrews and the bottom edge of the coupling plate 26 is coupled to the roller-mounting members 28 via capscrews. The coupling of the roller-mounting members 28 is such that they are arranged in a symmetrical fashion relative to each other. The rollers 30 are rotatably coupled to the distal end of the horizontal walls of the roller-mounting members 28 via shoulder bolts and arranged so that their circumferential surfaces slidably engage the top and bottom walls of the tubular tracks 20. (See FIG. 5.)

One of the sliding devices 22 further includes a locking component 31 which coordinates with the track locking components 24 to lock the machine 12 in the selected position. In the preferred and illustrated embodiment, the locking component 31 includes an L-shaped bracket 32 and a spring plunger 34. The horizontal leg of the bracket 32 is attached to the bottom of the lower roller-mounting member 28 via capscrews and the vertical leg of the bracket 32 is positioned adjacent the outer wall of the tubular track 20. The spring plunger 34 is mounted to the vertical leg of the bracket 32 so that it can be selectively inserted into, and retracted from, the track locking components, or openings, 24. (See FIG. 5.)

Referring now back to FIGS. 1–3, the cushioning conversion machine 12 is shown loaded with a roll of sheet-like stock material S. The stock material may consist of three superimposed webs of biodegradable, recyclable and reusable paper rolled onto a hollow cylindrical tube T. The machine 12 converts the stock material into a continuous unconnected strip having lateral pillow-like portions separated by a thin central band. This strip is coined along its central band to form a coined strip which is cut into sections, or pads P, of a desired length.

The cushioning conversion machine 12 includes a frame 36 and conversion assemblies which are mounted to the frame 36. The frame 36 includes a base plate 37, a pair of lateral side plates 38, an upstream end plate 39, a downstream end plate 40, a top cover 41, and back door 42. Because the machine 12 is positioned in a substantially horizontal manner, an imaginary longitudinal line or axis from its upstream end to its downstream end is substantially horizontal.

The base plate 37 and the side plates 38 are essentially solid rectangular sheets. The end plates 39 and 40 are also rectangular, however they are not solid. Instead, the upstream end plate 39 includes a large inlet opening which essentially results in the plate 39 resembling a border, rather then a plate. The downstream end plate 40 includes a relatively small outlet opening.

The top cover 41 includes a laterally extending hinge 43 and the orientation of this hinge 43 (i.e. laterally extending rather than longitudinally extending) results in the top cover 41 being openable when the machine 12 is situated in the upstream position. (See FIG. 2.) The back door 42 is pivotable between a closed condition whereat the downstream end plate 40 is covered and an open condition whereat the downstream end plate 40 is uncovered. (See FIG. 3.)

The machine's conversion assemblies include a stock supply assembly 50, a forming assembly 52, a gear assembly 54, a cutting assembly 56, and a post-cutting constraining assembly 58. Some of these conversion assemblies, namely the gear assembly 54 and the cutting assembly 56, are electrically controlled and the machine 12 includes an electric panel 60.

In operation of the machine 12, the stock supply assembly 50 supplies the stock material to the forming assembly 52. The forming assembly 52 causes inward rolling of the lateral edges of the sheet-like stock material to form the lateral pillow-like portions of the continuous strip. The gear assembly 54 pulls the stock material 22 through the machine and also coins the central band of the continuous strip to form the coined strip. The cutting assembly 56 cuts the coined strip into the cut sections, or pads, P. These cut sections then travel through the post-cutting constraining assembly 58.

In the preferred machine 12, the stock supply assembly 50 is mounted to an upstream side of the frame end plate 39 and thus is part of an upstream portion of the machine 12. The forming assembly 52 is mounted to the base plate 37 and the gear assembly 54 is mounted on an upstream side of the frame end plate 40. The forming assembly 52 is accessible when the top cover 41 is opened.

The cutting assembly 56, and also the electrical panel 60, are mounted on the downstream side of the second end plate 40 and thus are part of a downstream portion of the machine 12. These components are covered when the back door 42 is in the closed condition and uncovered when the door is in the open condition.

The post-cutting constraining assembly 58 extends outwardly from the door 42 and its overall geometry approximates a generally 90° curved arc. The exit opening 62 of the post-cutting constraining assembly 58 is the final outlet of the machine 12 as the cushioning product P emerges through this outlet during operation of the machine.

When the machine 12 is positioned in the operating position, its final outlet 62 is aligned with the table's opening 18 whereby the pads P will be deposited on the work platform 14. (See FIG. 1.) One may appreciate that the slidable mounting of the machine 12 is beneficial if only used in connection with the operating position because it allows for easy alignment of the machine's final outlet 62 and the table's opening 18. Moreover, the table 10 may be modified to include multiple dispensing openings and the slidable mounting of the machine 12 would allow a packaging person to select the appropriate dispensing opening.

When the machine 12 is slid to the upstream position, an upstream portion of the machine projects outwardly from the table 10. (See FIG. 2.) Thus, in the preferred embodiment, the stock supply assembly 50 projects outwardly from the table 10 and it may be conveniently reloaded with stock material. Additionally, because the top cover 41 is openable when the machine 12 is slid to the upstream position, the forming assembly 52 will be accessible for threading purposes. (See FIG. 2.)

When the machine 12 is slid to the downstream position, a downstream portion of the machine projects outwardly from the table 10. In this downstream position, the back door 42 may be opened whereby the cutting assembly 56 and/or the electric panel 60 will be easily accessible for testing and/or maintenance.

One may now appreciate that the table/machine combination of the present invention allows for convenient loading of stock material, easy threading of stock material, and/or handy maintenance of certain components of the machine. Although the invention has been shown and described with respect to a certain preferred embodiment, it is obvious that equivalent alterations and modifications will occur to others skilled in the art upon the reading and understanding of this specification. The present invention includes all such equivalent alterations and modifications and is limited only by the scope of the following claims.

What is claimed is:

1. In combination, a dispensing table and a cushioning conversion machine;

the dispensing table including a substantially horizontal work platform;

the cushioning conversion machine including a frame having an upstream end and a downstream end;

the cushioning conversion machine also including conversion assemblies which are mounted to the frame and which convert stock material into a cushioning product; and the cushioning conversion machine being movably positioned below the work platform and being movable in one direction to an operating position whereat the cushioning product is deposited on the work platform during operation of the machine and being movable in an opposite direction to a loading position whereat the machine may be loaded with stock material.

2. The table/machine combination set forth in claim 1 wherein the machine is positioned in a substantial horizontal orientation whereby an axis from the upstream end to the downstream end is substantially horizontal.

3. The table/machine combination set forth in claim 2 wherein the loading position is an upstream position whereat an upstream portion of the cushioning conversion machine projects outwardly from the table.

4. The table/machine combination set forth in claim 3 wherein the machine includes a stock supply assembly which is located at the upstream portion and therefore projects outwardly from the table when the machine is moved to the upstream position.

5. The table/machine combination set forth in claim 4 wherein the machine is movable to a downstream position whereat a downstream portion of the cushioning conversion machine projects outwardly from the table.

6. The table/machine combination set forth in claim 5 wherein the conversion assemblies include a cutting assembly which is located at the machine's downstream portion and therefore projects outwardly from the table when the machine is moved to the downstream position.

7. The table/machine combination set forth in claim 1 wherein the machine is movable to a downstream position whereat a downstream portion of the cushioning conversion machine projects outwardly from the table.

8. The table/machine combination set forth in claim 7 wherein the conversion assemblies include a cutting assembly which is located on the machine's downstream portion and therefore projects outwardly from the table when the machine is moved to the downstream position.

9. The table/machine combination set forth in claim 1 wherein the loading position is an upstream position whereat an upstream portion of the cushioning conversion machine projects outwardly from the table and wherein the machine includes a top cover which is openable when the machine is moved to the upstream position.

10. In combination, a cushioning conversion machine and a substantially horizontal work platform, wherein:

the cushioning conversion machine includes a frame having an upstream end and downstream end;

the cushioning conversion machine also includes conversion assemblies which are mounted to the frame and which convert sheet-like stock material into a cushioning product;

the cushioning conversion machine is positioned below the work platform and movable relative thereto;

the cushioning conversion machine being movable in one direction relative to the work platform between an operating position whereat the cushioning product is deposited on a top surface of the work platform and one of an upstream position or downstream position whereat a respective upstream or downstream portion of the machine projects outwardly from the work platform.

11. The combination set forth in claim 10 wherein the cushioning conversion machine is also slidable to another direction relative to the work platform whereat the other of the upstream portion or downstream portion of the machine projects outwardly from the work platform.

* * * * *